US005569370A

United States Patent [19]

Gomez

[11] Patent Number: 5,569,370

[45] Date of Patent: Oct. 29, 1996

[54] ELECTROCHEMICAL SYSTEM FOR RECOVERY OF METALS FROM THEIR COMPOUNDS

[75] Inventor: Rodolfo A. Gomez, Urrbrae, Australia

[73] Assignee: RMG Services Pty. Ltd., Adelaide, Australia

[21] Appl. No.: 318,782

[22] PCT Filed: Mar. 29, 1993

[86] PCT No.: PCT/AU93/00129

§ 371 Date: Oct. 3, 1994

§ 102(e) Date: Oct. 3, 1994

[87] PCT Pub. No.: WO93/20262

PCT Pub. Date: Oct. 14, 1993

[30] Foreign Application Priority Data

Apr. 1, 1992 [AU] Australia ..... PL1667
May 22, 1992 [AU] Australia ..... PL2554

[51] Int. Cl.[6] ..... C25C 1/12

[52] U.S. Cl. ..... 205/560; 205/580; 204/233; 204/234; 204/235; 204/236

[58] Field of Search ..... 204/233, 234, 204/261, 262, 263, 265, 105 R, 106, 270, 235, 236; 205/560, 580

[56] References Cited

U.S. PATENT DOCUMENTS

| | | | |
|---|---|---|---|
| 1,001,449 | 8/1911 | Robertson | 204/106 |
| 3,788,965 | 1/1974 | Holsinger | 204/234 |
| 3,926,752 | 12/1975 | Loretto et al. | 204/107 |
| 4,061,552 | 12/1977 | Everett | 205/543 |
| 4,159,232 | 6/1979 | Bacon et al. | 75/356 |
| 4,181,588 | 1/1980 | Wong et al. | 204/115 |
| 4,214,964 | 7/1980 | Cannell | 204/105 R |
| 4,594,132 | 6/1986 | Satchell | 204/105 R |
| 5,183,544 | 2/1993 | Weber et al. | 204/252 |

*Primary Examiner*—John Niebling
*Assistant Examiner*—Brendan Mee
*Attorney, Agent, or Firm*—Evenson, McKeown, Edwards and Lenahan, L.P.P.C.

[57] ABSTRACT

An electrochemical system for the recovery of metals from metal ores in which reactions are carried out in separate anode and cathode tanks with the liquid product from the anode tank being separated and purified before being returned to the cathode tank for metal deposition. The separation includes thickening such as liquid solid separation with the liquid proceeding to the cathode tank. A reaction stage may be included before the thickening stage. Purification may include removal of impurities, adjustment of chemical and physical conditions and the addition of cathode reaction enhancers.

12 Claims, 3 Drawing Sheets

ELECTROCHEMICAL SYSTEM FOR RECOVERY OF METALS FROM THEIR COMPOUNDS

INTRODUCTION

This invention concerns an electrochemical system and process and more particularly a system and process which will enable many electrochemical processes to dissolve and recover metals from their natural or artificial compounds at a commercial scale and on a continuous basis.

DISCUSSION OF PRIOR ART

Pyrometallurgical processes such as the KIVCET process and the ISASMELT process and hydrometallurgical processes such as the solvent extraction process; the Arbiter process using ammonia; the ElMCO Electro Slurry Process and the DEXTEC Copper Process among others were introduced in the last three or so decades for the extraction of metals from their ores. Most of these processes require considerable inputs of energy and produce considerable waste products or are limited in their commercial application.

The most appealing in terms of environmental effect, low cost and good recoveries and quality of product are electrolytic processes. These were the claims for the DEXTEC copper process which was developed in Australia. In this process the electrochemical dissolution and precipitation of the copper is carried out in a single cell where the dissolution of the fine sulfide copper ore using air and electricity in the anode section is separated by a diaphragm from the cathode section where copper is deposited by electrolysis. On a small scale the DEXTEC process produces copper metal in simple steps at low energy and reagent cost with minimum environmental effect. It appears, however, that the DEXTEC process is not suitable for commercial scale production due to the following difficulties.

1. The rate of the reaction appears to be controlled by the rate of travel of the copper ions through the diaphragm bag and is probably too slow for commercial application.
2. Problems of maintaining the small openings in the diaphragm bag from being blocked, up by small ore particles or by scale build-up.
3. Difficulty in maintaining the shape of and supporting the diaphragm bag.
4. Impurities dissolved at the anode section could not be removed and are precipitated with the copper at the cathode.

The electrical chemical system proposed in this invention overcomes the shortcomings of the conventional diaphragm cell described above and allow electrochemical reaction similar to the DEXTEC process to be carded out on a continuous commercial scale.

Other electrochemical processes recently disclosed in the prior art are as follows:

U.S. Pat. No. 4,181,588; Wong; Jan. 1, 1980

In this process, lead sulfide is leached with ferric chloride/sodium chloride solution in a separate vessel. The liquor is then filtered and introduced in an electrochemical cell where metallic lead is precipitated at the anode and the ferrous chloride passes through a diaphragm to the anode where it is oxidised to ferric chloride and re-cycled to the leaching tank.

U.S. Pat. No. 4,159,232; Bacon et al; Jun. 26, 1979

This process is aimed at obtaining copper and iron metal from an iron ore and nickel and iron metal from a nickel ore. Fine ore is dissolved in a leaching vessel with strong hydrochloric acid and sodium chloride. Contamination with oxygen is avoided as it will affect the electrolytic process. The leach liquor is separated and fed into the cathode compartment of the electrolytic cell where the copper is deposited and ferrous chloride and hydrogen is produced. Ferrous chloride diffuses to the anode and is oxidised to ferric chloride which is returned to the leaching tank. The hydrogen produced in the cathode is used to reduce some of the ferrous chloride to metallic iron.

This U.S. Patent discloses one variation where some copper sulfide is added to at least one anode compartment and then circulated to other anode compartments. There is no means of agitating the anode slurry as introduction of air Would be harmful to the chemical process of this US Patent.

U.S. Pat. No. 3,926,752; Loretto et al; Dec. 16, 1975

This patent concerns the recovery of metallic copper and also metallic iron from a copper ore by leaching with ferric chloride and hydrochloric acid in the anode compartment. A diaphragm separates the anode compartment from the cathode compartment. The ferrous chloride produced is oxidised to ferric chloride in the anode. Metallic iron is recovered in another cathode compartment after the feed solution is stripped of copper by iron filings.

Although different in chemistry, this US Patent is similar to the DEXTEC process which suffers limitations of diffusion through the diaphragm for continuous commercial operation.

U.S. Pat. No. 5,183,544; Weber et al; February, 1993

This U.S. Patent is aimed at recovering nickel metal from a high grade nickel hydroxide press cake. Part, if not much of the leaching of the nickel takes place in the leaching tanks. In the electrolytic cell, the nickel ions introduced or dissolved in the anode have to pass through a diaphragm to be reduced to metal in the cathode compartment. The limitation of the nickel ions having to migrate through the diaphragm is overcome by the purity and high concentration of nickel in the nickel hydroxide press cake.

The present invention aims to overcome the various problems which occur in the prior art discussed.

SUMMARY OF THE INVENTION

In one form therefore the invention is said to reside in a continuous process electrochemical metal recovery cell including;

- an anode tank for containing a slurry of a metal ore and having an anode immersed therein,
- means to supply fresh slurry of the metal ore to the anode tank,
- the anode tank including means to provide air sparging through fine nozzles or porous material into the slurry to provide agitation of the slurry within the anode tank and to provide oxidation conditions,
- a cathode tank for containing a cathode and having a cathode immersed therein,
- electrical connection between the cathode tank and the anode tank,
- means to supply an electrical current between the cathode and the anode,
- means to withdraw reacted slurry from the anode tank and to transfer it into a liquid/solid separation chamber, and
- means to transfer the liquid portion of the reacted slurry in the liquid/solid separation chamber to the cathode tank as the cathode.

It will be seen that by this device there is provided an arrangement where between the anode tank and the cathode tank the reacted slurry is withdrawn, has a liquid solid separation operation carried out on it and the liquid portion from the separation stage is then returned to the cathode tank for deposition of the metal. By this separation stage much of the problems of transfer of impurities into the cathode tank are removed and there will be no problems with blocking of a diaphragm between the anode tank and the cathode tank.

There may be further provided one or several purification stages to purify the separated liquid before it is transferred to the cathode tank. The purification may comprise solvent extraction, hydrogen sulphide precipitation, carbonation, cementation or other known purification processes. The liquid portion may also have solution conditions such as temperature and pH adjusted and have additives added to improve the subsequent electrolysis.

The metal recovery cell may further include a reaction container for withdrawn reacted slurry before the liquid solid separation stage so as to allow for complete reaction to the slurry before separation. The reaction section is optional only as some anode reactions may be fast or the liquid solid separation stage may provide sufficient time for the anode reactions to be completed.

The electrical connection between the cathode tank and the anode tank may comprise electrical conductors immersed into each tank and electrically connected outside the tanks. Such electrical conductors may be graphite or carbon rods or be a common wall made of carbon or graphite.

The anode may be provided by a plurality of carbon rods to provide sufficient surface area for the anode reaction to occur.

In a preferred form the cathode may be comprised of pure metal electrodes of the metal to be recovered.

The air added to the anode tank may be heated to provide and maintain a suitable reaction temperature in the anode tank.

In an alternate form the invention may be said to reside in a continuous process for electrochemical recovery of a metal from its ore in an electrochemical cell comprising the steps of;

supplying a slurry of the metal ore to an anode tank of the electrochemical cell, introducing air in the form of bubbles at a bottom of the anode tank to provide agitation of the slurry and to provide oxidation conditions in the anode tank, reacting the slurry of the ore in the anode tank by an anode reaction to leach metal values therefrom, withdrawing leached slurry from the anode tank and separating a liquid portion and a solid residue portion from the leached slurry, and passing the liquid portion to a cathode tank including a cathode of the electrochemical cell and providing an electrical connection between the anode tank and the cathode tank and an electrical current between the anode and the cathode to effect a cathode reaction to thereby deposit the metal at the cathode.

The air added to the anode tank may be heated to provide heating for the reaction to a desired temperature.

There may be included the further step of allowing reaction to take place in a reaction container before the liquid solid separation after removal of the leached slurry from the anode tank.

There may be further included the step of purification of the liquid portion before transferring it to the cathode tank.

The slurry in the anode tank may include a halite—acid or other suitable electrolyte solution. The spent liquor from the cathode tank may be used as make-up solution for making up further slurry before supplying the slurry to the anode tank.

The anode may be comprised of a plurality of carbon or graphite rods and the cathode may be comprised of a pure metal electrode of the same metal as that to be recovered in the electrochemical cell.

It will be seen that the main feature of the electrochemical cell of this invention is a system where the metals are dissolved in an anode section fitted with inert electrodes such as graphite electrodes and containing a slurry of the fine metal compound. The electrolyte or anolyte is agitated by the addition of air such as hot air from the bottom of the anode tank.

Products from the anode section are continually treated in a liquid solid separation stage and preferably the separated liquid is purified before it is returned to the cathode section of the electrochemical cell of this invention where the principle metal is electrolytically deposited.

Metals which may be recovered by the electrochemical process of the present invention include copper, nickel, cobalt, lead, zinc, iron, chromium, aluminium, titanium, gold, silver, manganese and other metals with similar electrical properties from their compounds or ores.

An important feature of the present invention is that both anode and cathode reactions are happening at the same time but are separated by an electrical conductor wall. Unlike the prior art diaphragm cell, the electrical conductor in the cell of the present invention is used only to prevent the anolyte from mixing with the cathode and does not require that metal ions migrate across the diaphragm for the cathode reaction to occur Problems of blockage of the diaphragm by solids can be eliminated by maintaining a slight hydraulic head in the cathode tank over the anode tank.

BRIEF DESCRIPTION OF THE DRAWINGS

This then generally describes the invention but to assist with understanding reference will be made to the accompanying drawings which show preferred embodiments of apparatus according to the invention and an example.

In the drawings.

DETAILED DESCRIPTION OF THE DRAWINGS

Figure 1:
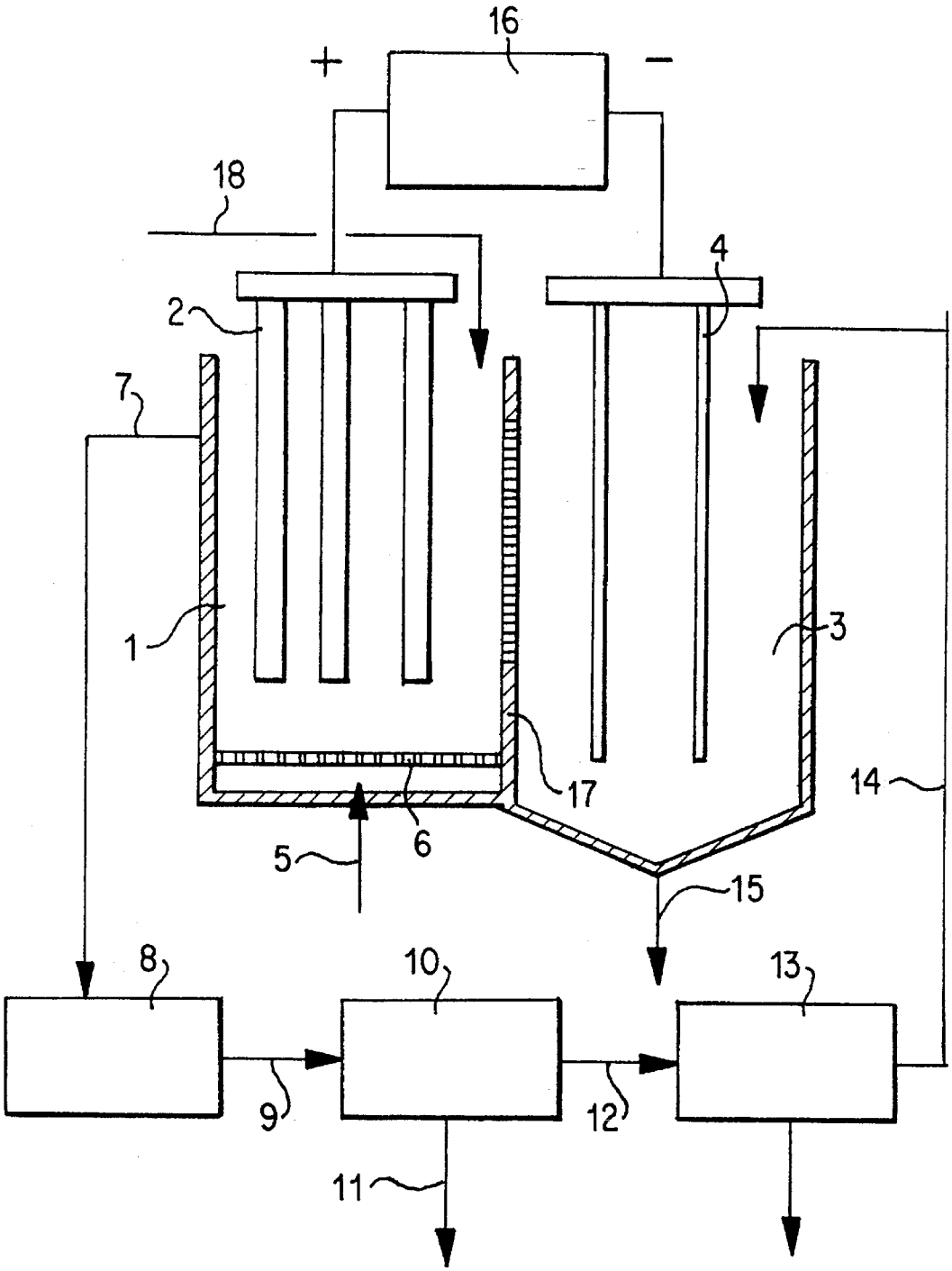
FIG. 1. shows a first embodiment of electrochemical cell according to this invention.

Now looking more closely at the drawings to be seen in particular in relation to FIG. 1 that the electrochemical cell according to this system includes an anode tank 1 having anodes 2 therein and a cathode tank 3 having cathodes 4 therein. The anode tank 1 includes a supply of slurry 18 into the tank and a supply of air 5 at its bottom end and appropriate porous material or sparging nozzles 6 to allow bubbles of air to pass through the slurry in the anode tank. Reacted slurry is drawn out through line 7 to an optional reaction container 8. After sufficient reaction time the slurry is passed through line 9 to a liquid solid separation stage 10. In this stage a solid leach residue 11 is produced and a liquid portion 12 is also produced. The liquid portion is transferred through line 12 to a solution purification stage 13. Purified solution is passed through line 14 to the cathode tank 3 and metal is deposited at the cathode 4 and the lean solution is withdrawn through line 15. A DC power source 16 is used to provide power to the anode and the cathode. The wall 17 between the cathode tank and anode tank electrically conductive to allow solution contact between the anode tank and the cathode tank.

It may be noted that the metal product produced in the cathode tank may be in a plate form deposited in the cathodes if a low current density is used or in a powder form if a high current density is used in the cathode.

Figure 2:
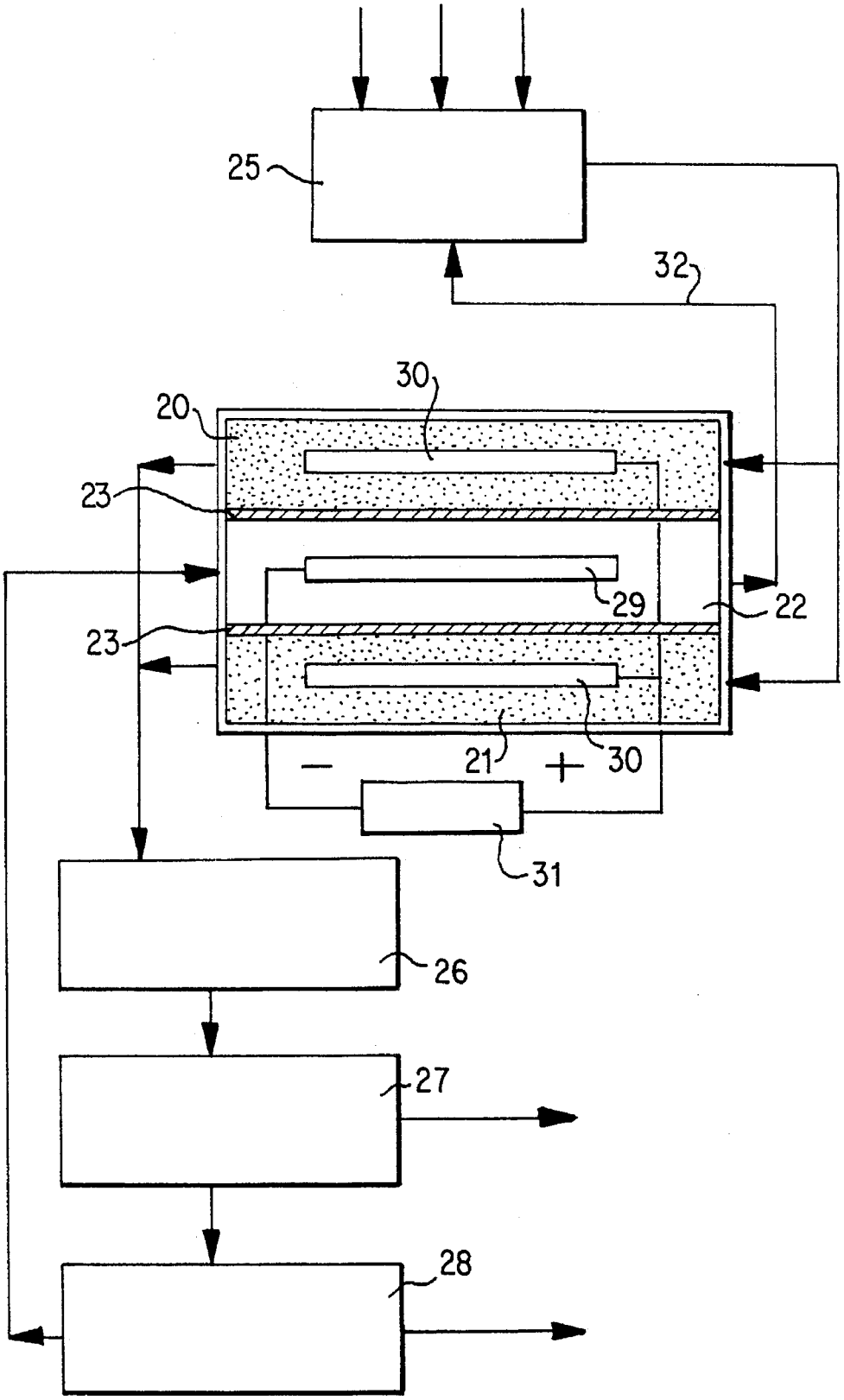
FIG. 2 shows an alternative embodiment electrochemical cell according to this invention.

Looking at FIG. 2 it will be seen that an alternative embodiment of electrochemical cells provided for which there are two anode sections either side of a cathode section. Although in this embodiment flow of anolyte is shown to be countercurrent to the flow of cathode the flow may be either co-current or countercurrent.

Slurry is prepared in slurry preparation stage 25 and passed into the two anode sections 20 and 21 including anodes 30. Reacted slurry is passed into an optional reaction section 26 and after sufficient reaction time passed to a liquid solid separation stage 27. Liquid from the liquid solid separation is passed to a solution purification stage 28 which may include adjustment of other properties such as pH and the pure rich liquid is passed into the cathode section 22. After depositing of the metal in the cathode section either onto cathode 29 or as a powder to the bottom of the cathode cell, lean liquid is withdrawn through line 32 to the slurry preparation stage for reuse. An electrically conductive wall 23 is provided either side of the cathode section 22 to provide solution contact between the anode tank 20 and the cathode tank 22. The electrical power to the anode and cathode is provided by power supply 31.

Figure 3:
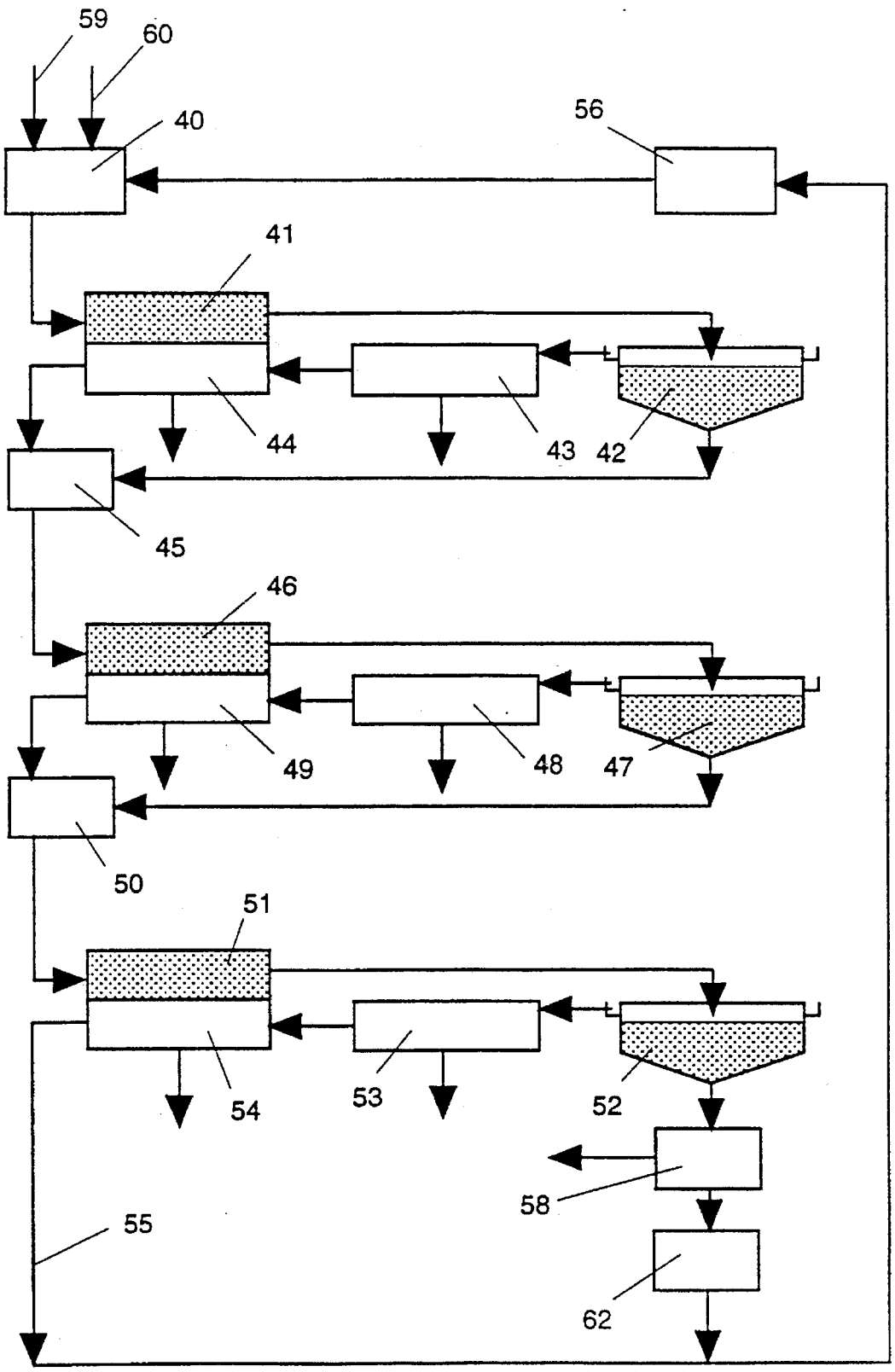
FIG. 3 shows a commercial scale electrochemical process according to this invention including multi-stage processing.

FIG. 3 shows an alternative embodiment of electrochemical system according to this invention in which a three stage process is used.

The slurry is prepared in slurry preparation stage 40 by adding finely ground metal ore 59, acid and reagents 60 and liquid from the solution storage tank 56 and is then passed into a first anode section 41. After reacting the leached slurry is passed to first thickener 42 from which liquid is passed to a solution purification stage 43 before being returned to the cathode section of the first stage 44. Lean liquid from the cathode 44 and thickened slurry from the thickener 42 is passed to mixing stage 45 which may include addition of acid and reagents before being passed to the anode section 46 of a second stage.

Once again leached slurry is passed to a thickener 47. Liquid from the thickener 47 is passed through a solution purification stage 48 and into the second stage cathode section 49. Lean solution from the cathode section 49 is mixed with thickened slurry from the thickener 47 in mixer 50 with any required acid or reagents and this mixed slurry is passed into the anode section 51 of the third stage.

Leached slurry of the third stage is passed to thickener 52 and liquid from this stage is passed through solution purification 53 before being passed to the cathode section of the third stage 54. The lean solution from the cathode section 54 is passed by means of line 55 to solution storage 56 and subsequently use for new slurry preparation in slurry preparation stage 40. Slurry underflow from the thickener 52 is washed in wash stage 58 and the residue discarded. The wash liquid may require some evaporation on evaporation stage 62 to remove some water to maintain process water balance before it is transferred to solution storage 56 for further use.

A certain amount of spent liquor may be discarded to prevent build up of undesirable salts.

It will be noted that metal product is produced from the cathode section of the first, second and third stages and this multistage system may be used to obtain a better recovery of a single metal or to separate We extraction of several metals.

EXAMPLE

A mixture of fine copper ore and anolyte which contains near saturated halite, about 12 grams per liter of copper, and sulfuric acid to keep the pH at about 2 to 2.5 is introduced into the anode section of an electrochemical cell according to this invention where graphite electrodes are immersed. Hot air is introduced through a disperser at the bottom of the anode section to provide agitation for the slurry, oxygen for the oxidising reactions at the anode, and heat to maintain the slurry temperature at 85 to 95 degrees Centigrade.

A low voltage at a low current density is applied to the graphite anodes where copper and other metals dissolve through the removal of electrons. Dissolved iron is converted to iron oxide precipitate and the sulfur remains as elemental sulfur.

The electro-leached slurry containing the dissolved metals is transferred to a reaction section to allow the oxidising reactions from the anode section to be completed to avoid interference in the cathode reactions. This reaction section is optional as some anode reactions may be fast enough and also, the liquid solid separation step may allow the anode reactions to be completed.

The leach residues are separated from the anolyte solution in the liquid solid separation step which may consist of thickening ahead of filtering and washing, or counter-current decantation with washing. The washings may require multistage evaporation before returning to the circuit to maintain the process water balance. The solids may go to waste or to further valuable metal or sulphur recovery.

The leach liquor may then go to solution purification for the removal of impurities such as silver, zinc, iron etc., if these interfere with the required quality of the copper metal deposit. It is also possible that solvent extraction is applied to remove the impurities, or to collect the copper from the impurities and the stripped solution containing the copper is then transferred to the cathode section for the electrolytic recovery of the copper.

In the normal case the purified copper solution is fed to the cathode section of electrochemical cell according to this invention where the copper is deposited on copper electrodes through the addition of electrons. Some reagents may be added to improve the purity of the copper deposited or to prevent problems such as growth of dendrites. The copper may be collected as a powder from the bottom of the cathode section if high current densities are used, and as sheets of copper on copper starter sheets if low current densities are used. Steam may be injected into the cathode section to provide heating and agitation. The hydraulic gradient in the cathode section is kept just above that in the anode section to give a minimal flow through the diaphragm from the cathode section to the anode section to prevent blinding of the diaphragm.

The diaphragm between the anode section and the cathode section is used to maintain solution contact between the anode section and the cathode section but to prevent the mixing of the anolyte and the cathode. In one embodiment graphite rods may be used to provide the solution contact between the anode section and the cathode section but under certain additions scale deposits on the graphite rods may break the contact. A diaphragm or a conductive material such as graphite may provide the solution Contact between the anode section and the cathode Section.

The lean solution discharged from the cathode section may be transferred to slurry feed preparation for the anode section or to a solution storage tank. Part of this lean solution may need to be discarded or treated to prevent the build-up of unwanted salts.

I claim:

1. A continuous process electrochemical metal recovery cell including;

an anode tank for containing a slurry of a metal ore and having an anode immersed therein, means to supply fresh slurry of the metal ore to the anode tank, the anode tank including means to provide air sparging through fine nozzles or porous material into the slurry to provide agitation of the slurry within the anode tank and to provide oxidation conditions, a cathode tank for containing a cathode and having a cathode immersed therein, a first electrode in contact with the slurry in the anode tank, a second electrode in contact with the catholyte in the cathode tank, and an electrical connection between the first electrode and the second electrode, means to supply an electrical potential between the cathode and the anode, wherein the electrical connection between the first electrode and the second electrode is electrically independent of the means for supplying an electrical potential between the cathode and the anode, means to withdraw reacted slurry from the anode tank and to transfer it into a liquid/solid separation chamber, and means to transfer the liquid portion of the reacted slurry in the liquid/solid separation chamber to the cathode tank as the catholyte;

whereby to deposit metal at the cathode.

2. An electrochemical metal recovery cell as in claim 1 further including a purification tank to purify the separated liquid portion before it is transferred to the cathode tank.

3. An electrochemical metal recovery cell as in claim 1 further including a reaction container for withdrawn reacted slurry before the liquid/solid separation chamber so as to allow complete anode reaction of the slurry before separation.

4. An electrochemical metal recovery cell as in claim 1 wherein the anode comprises a plurality of carbon or graphite rods.

5. An electrochemical metal recovery cell as in claim 1 wherein the cathode comprises the metal to be recovered.

6. An electrochemical metal recovery cell as in claim 1 wherein there are means to heat the air before sparging into the slurry to provide reaction heat in the anode tank.

7. A continuous process for electrochemical recovery of a metal from its ore in an electrochemical cell comprising the steps of;

supplying a slurry of the metal ore to an anode tank of the electrochemical cell, introducing air in the form of bubbles at the bottom of the anode tank to provide agitation of the slurry and to provide oxidation conditions in the anode tank reacting the slurry of the ore in the anode tank by an anode reaction to leach metal values therefrom, withdrawing leached slurry from the anode tank and separating a liquid portion and a solid residue portion from the leached slurry, and passing the liquid portion to a cathode tank including a cathode of the electrochemical cell and providing an electrical connection between a first electrode in the anode tank and a second electrode in the cathode tank said electrical connection between the first electrode and the second electrode being independent of any electrical connection between the anode and the cathode and supplying an electrical potential between the anode and the cathode to effect a cathode reaction to thereby deposit the metal at the cathode.

8. A process as in claim 7 wherein the air is heated to provide heating to the anode reaction in the anode tank.

9. A process as in claim 7 further including the step of allowing the anode reaction of the withdrawn leached slurry to complete in a reaction container before the liquid/solid separation step.

10. A process as in claim 7 further including the step of purification of the liquid portion before transferring it to the cathode tank.

11. A process as in claim 7 wherein the anode comprises a plurality of carbon or graphite rods.

12. A process as in claim 7 wherein the cathode comprises a metal the same as that to be recovered in the electrochemical cell.

* * * * *